US011221176B2

(12) United States Patent
Roberts et al.

(10) Patent No.: US 11,221,176 B2
(45) Date of Patent: Jan. 11, 2022

(54) NATURAL GAS LIQUEFACTION WITH INTEGRATED NITROGEN REMOVAL

(71) Applicant: Air Products and Chemicals, Inc., Allentown, PA (US)

(72) Inventors: Mark Julian Roberts, Kempton, PA (US); Fei Chen, Whitehouse Station, NJ (US); Christopher Michael Ott, Macungie, PA (US); Annemarie Ott Weist, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 56 days.

(21) Appl. No.: 16/103,479

(22) Filed: Aug. 14, 2018

(65) Prior Publication Data

US 2020/0056836 A1 Feb. 20, 2020

(51) Int. Cl.
*F25J 3/02* (2006.01)
*F25J 1/00* (2006.01)

(52) U.S. Cl.
CPC ..... *F25J 1/0015* (2013.01); *F25J 1/004* (2013.01); *F25J 1/0025* (2013.01); *F25J 1/0052* (2013.01); *F25J 1/0072* (2013.01); *F25J 3/0209* (2013.01); *F25J 3/029* (2013.01); *F25J 3/0257* (2013.01)

(58) Field of Classification Search
CPC ..... F25J 1/0022; F25J 1/0025; F25J 3/0233; F25J 3/029; F25J 3/0257; F25J 3/0209; F25J 1/0072; F25J 1/0211–0219; F25J 1/0248–025
See application file for complete search history.

(56) References Cited

U.S. PATENT DOCUMENTS

| | | | | |
|---|---|---|---|---|
| 4,225,329 | A * | 9/1980 | Bailey | F25J 1/0022 62/623 |
| 6,449,984 | B1 | 9/2002 | Paradowski | |
| 7,520,143 | B2 | 4/2009 | Spilsbury | |
| 10,024,595 | B2 | 7/2018 | Howard | |
| 2007/0245771 | A1* | 10/2007 | Spilsbury | |
| 2010/0223951 | A1 | 9/2010 | Jager et al. | |
| 2011/0041389 | A1* | 2/2011 | Bauer | F25J 1/0219 44/458 |
| 2012/0198883 | A1* | 8/2012 | Bauer | F25J 1/004 62/613 |
| 2015/0308736 | A1* | 10/2015 | Chen | |

(Continued)

FOREIGN PATENT DOCUMENTS

| | | |
|---|---|---|
| DE | 102009015766 | 10/2010 |
| JP | 2016505793 | 2/2016 |
| WO | 2013087569 | 6/2013 |

*Primary Examiner* — Frantz F Jules
*Assistant Examiner* — Webeshet Mengesha
(74) *Attorney, Agent, or Firm* — Amy Carr-Trexler

(57) ABSTRACT

A natural gas liquefaction method and system having integrated nitrogen removal. Recycled LNG gas is cooled in a separate and parallel circuit from the natural gas stream in the main heat exchanger. Cooled recycled gas and natural gas streams are directed to a nitrogen rectifier column after the warm bundle. The recycle stream is introduced to the rectifier column above the natural gas stream and at least one separation stage is located in the rectifier column between the recycle stream inlet and the natural gas inlet. The bottom stream from the rectifier column is directed to a cold bundle of the main heat exchanger where it is subcooled.

16 Claims, 8 Drawing Sheets

(56) References Cited

U.S. PATENT DOCUMENTS

| | | | |
|---|---|---|---|
| 2015/0308737 | A1 | 10/2015 | Chen et al. |
| 2015/0308738 | A1 | 10/2015 | Chen et al. |
| 2016/0313057 | A1* | 10/2016 | Roberts |

* cited by examiner

NATURAL GAS LIQUEFACTION WITH INTEGRATED NITROGEN REMOVAL

BACKGROUND OF THE INVENTION

This application relates to a method for liquefying a natural gas feed stream and removing nitrogen therefrom. This application also relates to an apparatus (such as for example a natural gas liquefaction plant or other form of processing facility) for liquefying a natural gas feed stream and removing nitrogen therefrom.

In processes for liquefying natural gas it is often desirable or necessary, for example due to purity and/or recovery requirements, to remove nitrogen from the feed stream while minimizing product (methane) loss. The removed nitrogen product may be used as fuel gas or vented to atmosphere. If used as fuel gas, the nitrogen product must contain a sufficient amount of methane (typically greater than 30 mol percent) to maintain its heating value. In this case, the separation of nitrogen is not as difficult due to loose specifications on the purity of the nitrogen product, which dictates use of nitrogen removal process requiring with minimal additional equipment and power consumption. In many small and mid-scale liquefied natural gas (LNG) facilities that are driven by electric motors, however, there is very little demand for fuel gas and the nitrogen product is vented to the atmosphere. If vented, the nitrogen product is subject to more strict purity specifications. e.g., greater than 95 mol percent and in some cases, greater than 99 mol percent, due to environmental concerns and/or methane recovery requirements.

In such application, this relatively high nitrogen purity requirement presents technical challenges and economic challenges. In the case of a very high nitrogen concentration (typically greater than 10 mol percent, in some cases up to or even higher than 20 mol percent) in the natural gas feed, a dedicated nitrogen rejection unit (NRU) can provide a robust method to efficiently remove nitrogen and produce a pure (greater than 99 mol percent) nitrogen product. However, there are many applications in which the natural gas feed contains 10 mol percent nitrogen or less. In such applications a dedicated NRU is often not feasible, due to high capital costs and equipment complexity. In addition, the fact that nitrogen concentrations in many natural gas feeds are subject to relatively large swings dictates an NRU that can adapt to variations in nitrogen concentrations.

Some attempts have been made to solve these challenges, including adding a nitrogen recycle stream to the NRU or using a dedicated rectifier column. However, these processes often are very complex, necessitate a large amount of equipment (with associated capital costs), are difficult to operate, and/or are inefficient, particularly for feed streams having low nitrogen concentrations (i.e., less than 5 mol percent). Furthermore, it is often the case that the nitrogen concentration in a natural gas feed will change from time to time, which means that even if one is dealing with a feed that is currently high in nitrogen content, one cannot guarantee that this will remain the case.

Accordingly, there is a need for a simple, efficient, and cost effective nitrogen removal process that is capable of removing nitrogen from natural gas feeds with low nitrogen concentrations and variations in nitrogen concentration.

SUMMARY OF THE INVENTION

Several specific aspects of the systems and methods of the present invention are outlined below.

Aspect 1: A method for producing a nitrogen-depleted LNG product, the method comprising:

(a) passing a natural gas feed stream through a first circuit of a main heat exchanger to cool the natural gas feed stream and liquefy at least a portion of the natural gas stream against a first refrigerant, thereby producing a first cooled LNG stream;

(b) withdrawing the first cooled LNG stream from the main heat exchanger;

(c) expanding the first cooled LNG stream to form a first reduced pressure LNG stream;

(d) introducing the first reduced pressure LNG stream into a nitrogen rectifier column at a first location, the first location being located at a bottom end of the nitrogen rectifier column;

(e) withdrawing a first LNG bottoms stream from the bottom end of the nitrogen rectifier column;

(f) withdrawing an overhead stream from the nitrogen rectifier column;

(g) cooling the first LNG bottoms stream to create a subcooled LNG stream;

(h) directing at least a portion of the subcooled LNG stream to a flash drum or an LNG storage tank;

(i) collecting at least one selected from the group of: a flash gas stream from the flash drum and a boil-off gas stream from the LNG storage tank to form a recycle stream;

(j) passing the recycle stream through a second circuit of the main heat exchanger to cool the recycle stream and liquefy at least a portion of the recycle stream, thereby producing an at least partially liquified recycle stream;

(k) expanding the at least partially liquified recycle stream to form a reduced pressure recycle stream; and (l) introducing the reduced pressure recycle stream into the nitrogen rectifier column at a second location, the second location being located above the first location and at least one separation stage being located in the nitrogen rectifier column between the first location and the second location.

Aspect 2: The method of Aspect 1, further comprising:

(m) using the subcooled liquid LNG stream to provide cooling duty to the nitrogen rectifier column.

Aspect 3: The method of Aspect 2, further comprising:

(n) at least partially vaporizing the subcooled liquid LNG stream before performing step (m).

Aspect 4: The method of any of Aspects 1-3, further comprising:

(o) compressing and cooling the first refrigerant in a refrigeration loop;

(p) withdrawing a slip stream of the first refrigerant to provide cooling duty to the nitrogen rectifier column.

Aspect 5: The method of any of Aspects 1-4, further comprising:

(q) directing the at least a portion of the subcooled LNG stream to a flash drum.

Aspect 6: The method of any of Aspects 1-5, further comprising:

(r) compressing and cooling the recycle stream before performing step (j).

Aspect 7: The method of any of Aspects 1-6, further comprising:

(s) after performing step (b) and before performing step (d), further cooling the first LNG stream by indirect heat exchange against a reboil stream from the bottom end of the nitrogen rectifier column, thereby producing a warmed reboil stream;

(t) introducing the warmed reboil stream into the bottom end of the nitrogen rectifier column.

Aspect 8: The method of any of Aspects 1-7, wherein step (h) further comprises separating the subcooled liquid LNG stream into the liquid LNG product stream and the vapor LNG product stream in a nitrogen stripper column; and the method further comprises:

(u) withdrawing a nitrogen enriched vapor stream from an upper end of the nitrogen rectifier column, passing the nitrogen enriched vapor stream through a condenser heat exchanger located in the nitrogen stripper column to provide a boiling duty to the nitrogen stripper column, which produces an at least partially liquefied nitrogen enriched stream; and (v) returning the at least partially liquefied nitrogen enriched stream to the upper end of the nitrogen rectifier column.

Aspect 9: The method of any of Aspects 1-8, further comprising:

(w) further cooling the overhead stream in an overhead hear exchanger and separating a further cooled overhead stream into a nitrogen-enriched stream and a hydrogen/helium-enriched stream;

(x) expanding nitrogen-enriched stream and using the expanded nitrogen-enriched stream to provide a refrigeration duty to the overhead heat exchanger.

Aspect 10: The method of any of Aspects 1-9, further comprising:

(y) separating the overhead stream into a nitrogen-enriched stream and a hydrogen/helium-enriched stream using a pressure swing adsorption or membrane unit.

Aspect 11: The method of any of Aspects 1-10, further comprising:

(z) separating the subcooled LNG stream into an LNG product stream and a vapor NG product stream;

wherein step (i) further comprises directing the LNG product stream to the LNG storage tank.

Aspect 12: The method of Aspect 11, further comprising:

(aa) combining the boil-off gas stream with the vapor NG product stream to form the recycle stream.

Aspect 13: The method of any of Aspects 1-12, wherein step (d) comprises introducing the first reduced pressure LNG stream into the nitrogen rectifier column at the first location, the first location being located below any separation stages located within the nitrogen rectifier column.

Aspect 14: The method of any of Aspects 1-13, further comprising:

(ab) directing a slip stream from the natural gas feed stream to the bottom end of the nitrogen rectifier column.

Aspect 15: An apparatus for producing a nitrogen-depleted LNG product, the apparatus comprising:

a main heat exchanger having a first set of cooling passages for receiving a natural gas feed stream and passing said stream through the heat exchanger to cool the natural gas feed stream and liquefy at least a portion of the natural gas feed stream so as to produce a first LNG stream and a subcooled LNG stream, the main heat exchange further comprising a second set of passages for receiving a recycle stream and passing the recycle stream through the main heat exchanger to cool and at least partially liquefy the recycle stream to produce a first at least partially liquefied recycle stream, wherein said cooling passages are arranged to pass the recycle stream through the heat exchanger separately from, and in parallel with, the natural gas feed stream;

a refrigeration system for supplying a refrigerant to the main heat exchanger for cooling the first and second set of cooling passages;

a first separation system, in fluid flow communication with the main heat exchanger, for receiving, expanding, partially vaporizing and separating the first LNG stream, or an LNG stream formed from part of the first LNG stream, to form a bottom stream and an overhead stream, the first separation system including a recycle stream inlet and an LNG stream inlet that is located above the recycle stream inlet the first separation system further including at least one separation stage located between the recycle stream inlet and the LNG stream inlet; and a storage tank for receiving and storing the subcooled LNG stream, the storage tank being in fluid flow communication with the recycle stream;

wherein the bottom stream is in fluid flow communication with the first set of passages in a cold bundle of the main heat exchanger operationally configured to subcool the bottom stream to form the subcooled LNG stream.

Aspect 16: The system of Aspect 15, further comprising a compressor for receiving the recycle stream from the storage tank and compressing the recycle stream to form a compressed recycle stream and returning the compressed recycle stream to the main heat exchanger.

Aspect 17: The system of any of Aspects 15-16, wherein the first separation system further comprises a condenser heat exchanger adapted to use the subcooled LNG stream to provide a condensation duty to the first separation system.

Aspect 18: The system of Aspect 17, further comprising a flash drum located downstream from the condenser heat exchanger and upstream from the storage tank.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENTS

Figure 1:
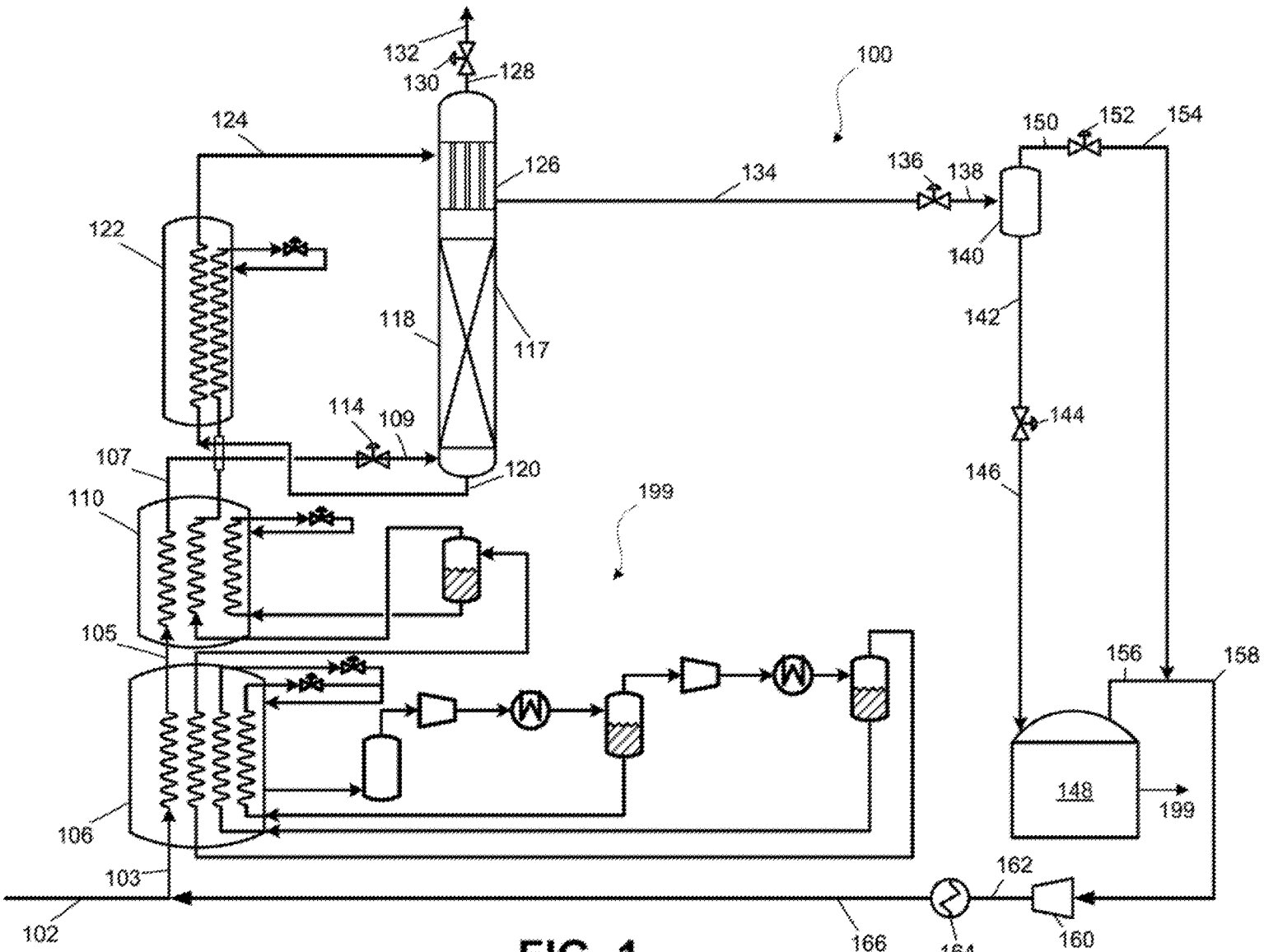
FIG. 1 is a block diagram of a first exemplary embodiment of a natural gas liquefaction system having a dedicated nitrogen removal system.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

The term "fluid flow communication," as used in the specification and claims, refers to the nature of connectivity between two or more components that enables liquids, vapors, and/or gases to be transported between the components in a contained fashion (i.e., without substantial leakage). Coupling two or more components such that they are in flow communication with each other can involve any suitable method known in the art, such as with the use of welds, flanged conduits, gaskets, and bolts. Two or more components may also be coupled together via other components of the system that may separate them.

The term "natural gas", as used in the specification and claims, means a hydrocarbon gas mixture consisting primarily of methane.

The term "separation stage", as used in the specification and claims, is intended to mean a vapor-liquid contacting device which enables mass transfer between a rising vapor and a descending liquid, such that the vapor leaves the device in equilibrium with the liquid. Examples of vapor-liquid contacting devices include any type of device commonly known in the industry, such as trays (valve trays, sieve trays, etc.) or packing (structured packing, random packing, etc.).

The term "bundle", as used in the specification and claims, is intended to refer to a portion of a coil wound heat exchanger comprising a shell and at least one circuit of wound tubes.

The term "light component", as used in the specification and claims, is intended to refer to a component of a fluid having a normal boiling point lower than methane.

In this disclosure, elements shared between embodiments are represented by reference numerals increased by factors of 100. For example, the flash drum 240 in FIG. 2 corresponds to the flash drum 540 in FIG. 5. In the interest of clarity, some features of the embodiments that are shared with an earlier embodiment are numbered in subsequent figures but are not repeated in the specification. If a numbered feature is not specifically described in a subsequent embodiment, it may be assumed that this feature is substantially identical in structure and performs substantially the same function as in the last embodiment in which the feature was described.

A first exemplary embodiment of a natural gas liquefaction system 100 is shown in FIG. 1. A natural gas (NG) feed 102 is combined with a recycle stream 166 containing boil-off-gas (BOG) and/or flash gas to form a combined NG/BOG stream 103 that is cooled in a warm bundle 106 to produce a cooled NG/BOG stream 105. The cooled NG/BOG stream 105 is at least partially liquefied in a middle bundle 110 to produce an at least partially liquefied NG stream 107. The at least partially liquefied NG stream 107 is let down in pressure through a valve 114 to produce a reduced pressure NG stream 109, which enters the bottom end of a nitrogen (N2) rectifier column 118, below all of the separation stages 117.

A bottom liquid stream 120 from the N2 rectifier column 118 is depleted in light components and continues to be subcooled in a cold bundle 122 to make a subcooled LNG stream 124. The subcooled LNG stream 124 enters a condenser heat exchanger 126 to provide cooling duty to the N2 rectifier column 118. The LNG stream 134 exiting the condenser heat exchanger 126 is reduced in pressure through a valve 136 to produce a first reduced pressure LNG stream 138 that is optionally further reduced in pressure in a flash drum 140 to produce an overhead LNG stream 150 and a bottom LNG product 142.

The bottom LNG product 142 from the flash drum 140 is sent to a LNG storage tank 148 via a line 146 and a valve 144. LNG product may be discharged from the storage tank 148 via line 199. The overhead LNG stream 150 from the flash drum 140 is reduced in pressure via a valve 152 combined, via line 154, with a BOG gas stream 156 from the LNG storage tank 148 to form a recycle stream 158. The recycle stream 158 is preferably compressed in a BOG compressor 160 to form a compressed recycle stream 162 which is then preferably cooled in an air cooler 164 to create the BOG recycle stream 166 that combines with the natural gas feed 102 to form the combined NG/BOG stream 103.

An overhead stream 128, enriched in light components such as N2, H2 and He, is withdrawn from the upper end of the N2 rectifier column 118 (above the partial condenser 126) and is used as fuel or vented to the atmosphere via a valve 130 and line 132.

The system 100 includes a refrigeration system 199, which provides refrigeration duty to the warm bundle 106, middle bundle 110, and cold bundle 122. The refrigeration system shown in FIG. 1 is an exemplary closed-loop system in which a refrigerant is cooled in each bundle in a dedicated circuit, then is expanded and introduced into a shell side of each bundle to provide refrigeration duty to the natural gas. Refrigerant is withdrawn from the bottom of the shell side of the warm bundle and is compressed and cooled before being recirculated to the bundles. Any suitable refrigeration system or process could be used in place of system 199 in any of the embodiments described herein. In the interest of simplifying the drawings, the refrigeration system 199 is not shown in FIGS. 2 through 7 but should be understood as being part of each exemplary liquefaction system.

Figure 2:
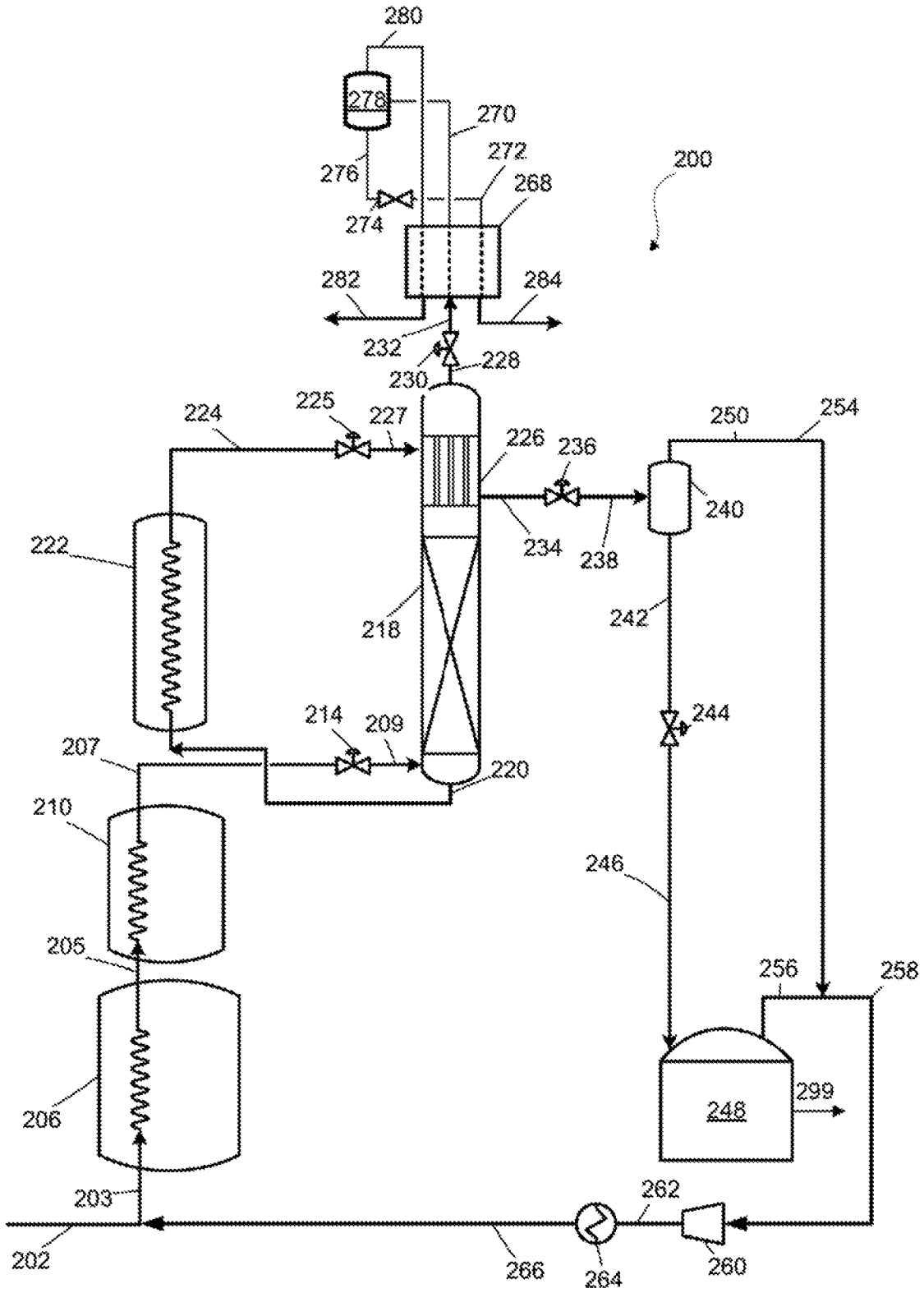
FIG. 2 is a block diagram of a second exemplary embodiment of a natural gas liquefaction system having a dedicated nitrogen removal system.

A second exemplary embodiment of the system 200 is shown in FIG. 2. This embodiment is nearly identical to the system 100 of FIG. 1, except in the handling of the overhead stream 228. In system 200, the overhead stream 228 of the N2 rectifier column 218 is transferred via a valve 230 and line 232 to a heat exchanger 268, where it is further cooled into a cooled overhead stream 270. The cooled overhead stream 270 is then phase separated in a flash drum 278 to produce a H2/He enriched stream 280 and a N2 enriched stream 276. The N2 enriched stream 276 is let down in pressure via a valve 274 to create a reduced pressure N2 enriched stream 272 which is sent to the heat exchanger 268 to provide refrigeration before being vented to the atmosphere 284. The H2/He enriched stream 280 is optionally sent to the exchanger 268 to provide refrigeration before being transferred via a line 282 to an H2 recycle system (not shown).

One other change from the system 100 of FIG. 1 in system 200 is the positioning of a valve 225. In this system 200, the subcooled LNG stream 224 is reduced in pressure by the valve 225, to produce a reduced pressure subcooled LNG stream 227, which is then introduced into the condenser heat exchanger 226.

Figure 3:
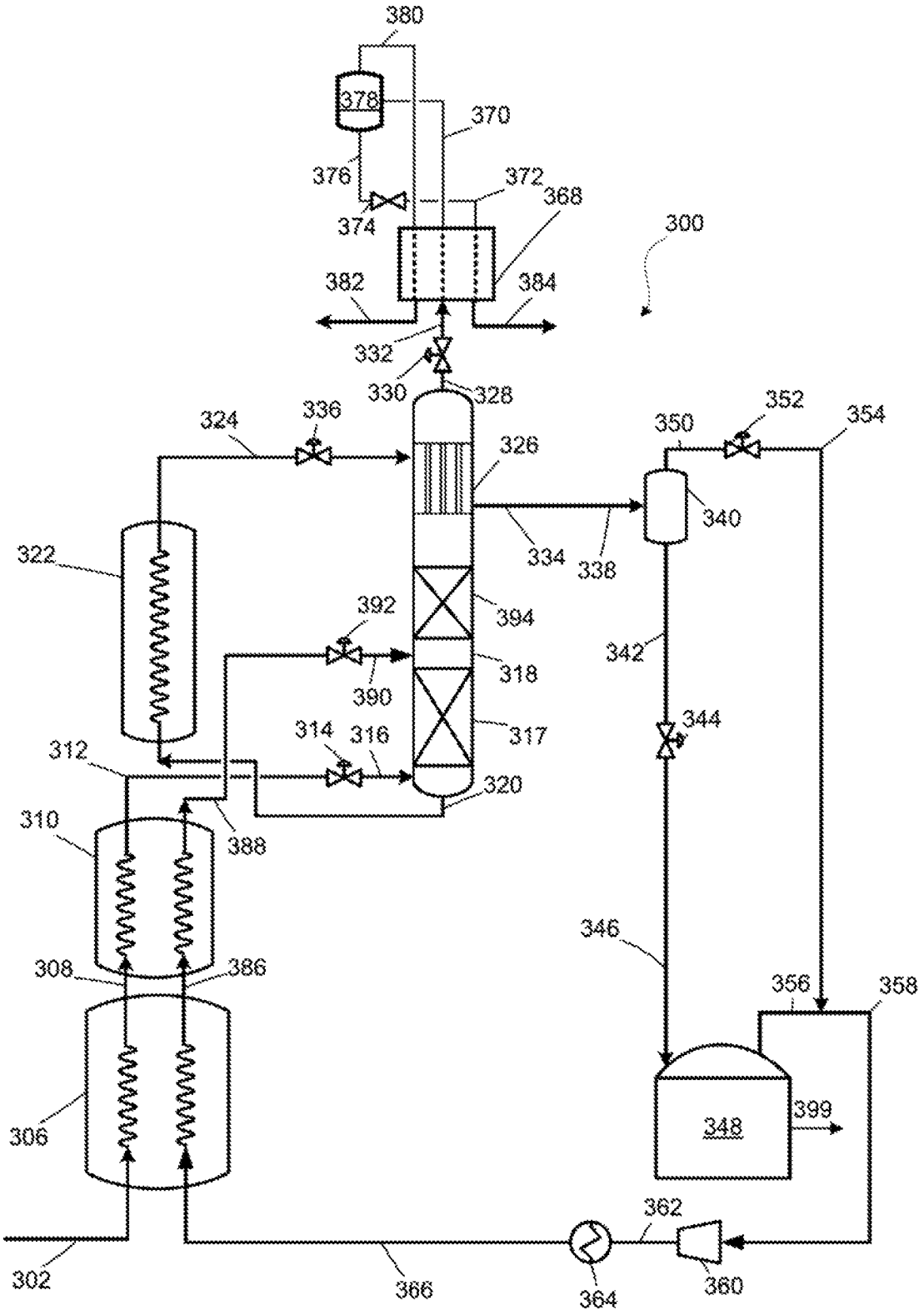
FIG. 3 is a block diagram of a third exemplary embodiment of a natural gas liquefaction system having a dedicated nitrogen removal system.

A third exemplary embodiment of the system 300 is shown in FIG. 3. In FIG. 3, the natural gas feed 302 is cooled separately from the recycle stream 358. The natural gas feed 302 is first cooled in the warm bundle 306 to produce a cooled NG stream 308 and at least partially liquefied in the middle bundle 310 to produce an at least partially liquefied NG stream 312. The at least partially liquefied NG stream 312 is let down in pressure through a valve 314 to produce reduced pressure NG stream 316, which enters a N2 rectifier column 318. The bottom liquid stream 320 from the N2 rectifier column 318 is depleted in light components and continues to be subcooled in a cold bundle 322 to produce a subcooled LNG stream 324. The subcooled LNG stream 324 enters the condenser heat exchanger 326, to provide cooling duty to the N2 rectifier column 318. The LNG stream 334 exiting the condenser heat exchanger 326 is further reduced in pressure through a valve 336 to produce a first reduced pressure LNG stream 338 that is optionally further reduced in pressure in a flash drum 340 to produce an overhead NG stream 350 and a bottom LNG product 342.

The bottom LNG product 342 from the flash drum 340 is sent to a LNG storage tank 348 via line 346 and a valve 344. The overhead 350 of the flash drum 340 is directed via a valve 352 and line 354 to combine with the BOG gas 356 from the LNG storage tank 348 to make a recycle stream 358. The recycle stream 358 is compressed in a BOG compressor 360 to form a compressed recycle stream 362 which is then cooled in an air cooler 364 to create a BOG recycle stream 366.

In this embodiment, the recycle stream 366 is at least partially liquefied separately and in parallel with the natural gas feed stream 302 in the warm bundle 306 and the middle bundle 310 to create an at least partially liquified recycle stream 388. The at least partially liquefied recycled stream 388 is let down in pressure via a valve 392 to create a reduced pressure recycle stream 390. The reduced pressure recycle stream 390 is introduced into the N2 rectifier column 318 at a location higher than the location where stream 316 is introduced and there is at least one separation stage 317 between these two locations.

The N2 rectifier column overhead 328, enriched in light components such as N2, H2 and He, is processed similarly to the system 200 of FIG. 2.

Figure 4:
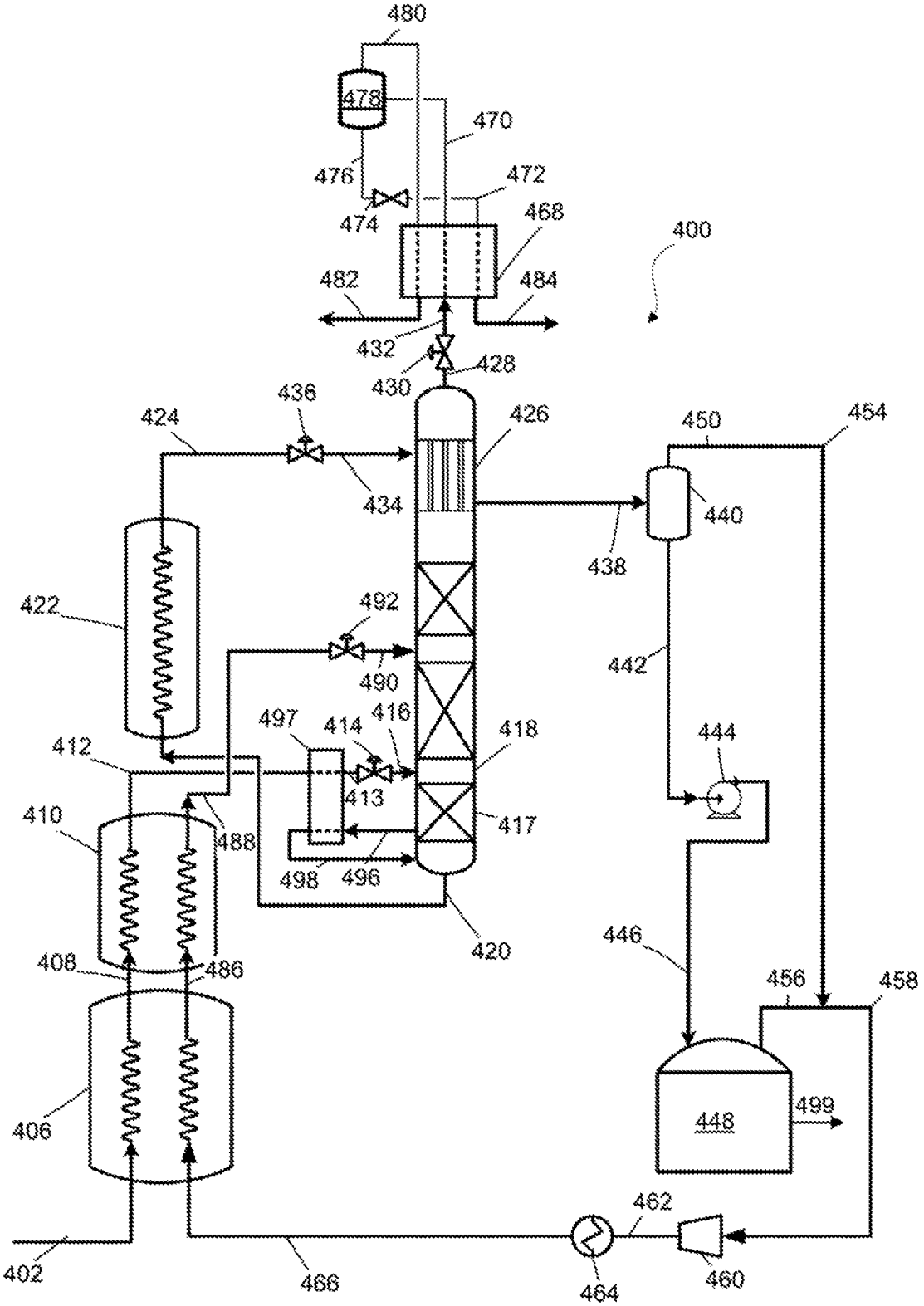
FIG. 4 is a block diagram of a fourth exemplary embodiment of a natural gas liquefaction system having a dedicated nitrogen removal system.

A fourth exemplary embodiment of the system 400 is shown in FIG. 4. In this embodiment, the at least partially liquefied NG stream 412 is further cooled in a reboiler heat exchanger 497 to produce a further cooled, partially liquefied NG stream 413. The further cooled partially liquefied NG stream 413 is let down in pressure through valve 414 to produce a reduced pressure partially liquefied LNG stream 416. As in the system 300 of FIG. 3, the reduced pressure partially liquefied LNG stream 416 enters a N2 rectifier column 418 at a location above one set of separation stages 417.

The reboiler heat exchanger 497 provides a heating duty to the bottom of the N2 rectifier column 418 via line 496 and return line 498. The bottom liquid stream 420 from the N2 rectifier column 418 is depleted in light components and continues to be subcooled in a cold bundle 422 to make subcooled LNG stream 424. The subcooled LNG stream 424 enters a condenser heat exchanger 426 to provide cooling duty to the N2 rectifier column 418.

The LNG stream 434 exiting the condenser heat exchanger 426 is further reduced in pressure through a valve 436 to produce a first reduced pressure LNG stream 438 that is optionally further reduced in pressure in a flash drum 440 to produce an overhead LNG stream 450 and a bottom LNG product 442. The bottom LNG product 442 from the flash drum 440 is sent to a LNG storage tank 440 via line 446 and, if necessary, is pumped via pump 444.

Figure 4A:
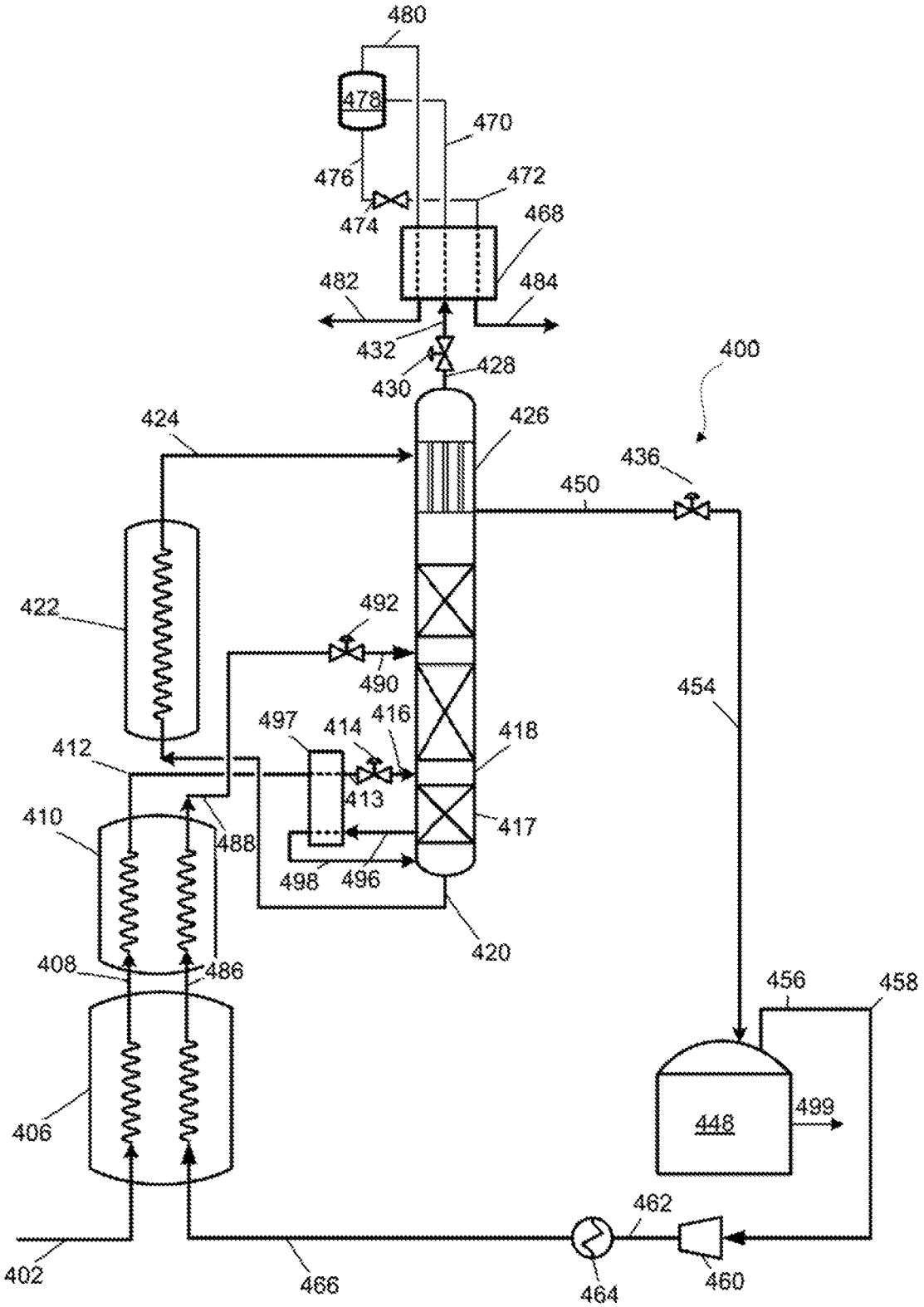
FIG. 4A is a block diagram of an optional variation on the system shown in FIG. 4.

An optional variation on the system 400 is shown in FIG. 4A. In FIG. 4A, the first reduced pressure LNG stream 438 is reduced in pressure by a valve 436 and is directed to the LNG storage tank 448 via line 454 instead of being further separated in a flash drum.

Figure 5:
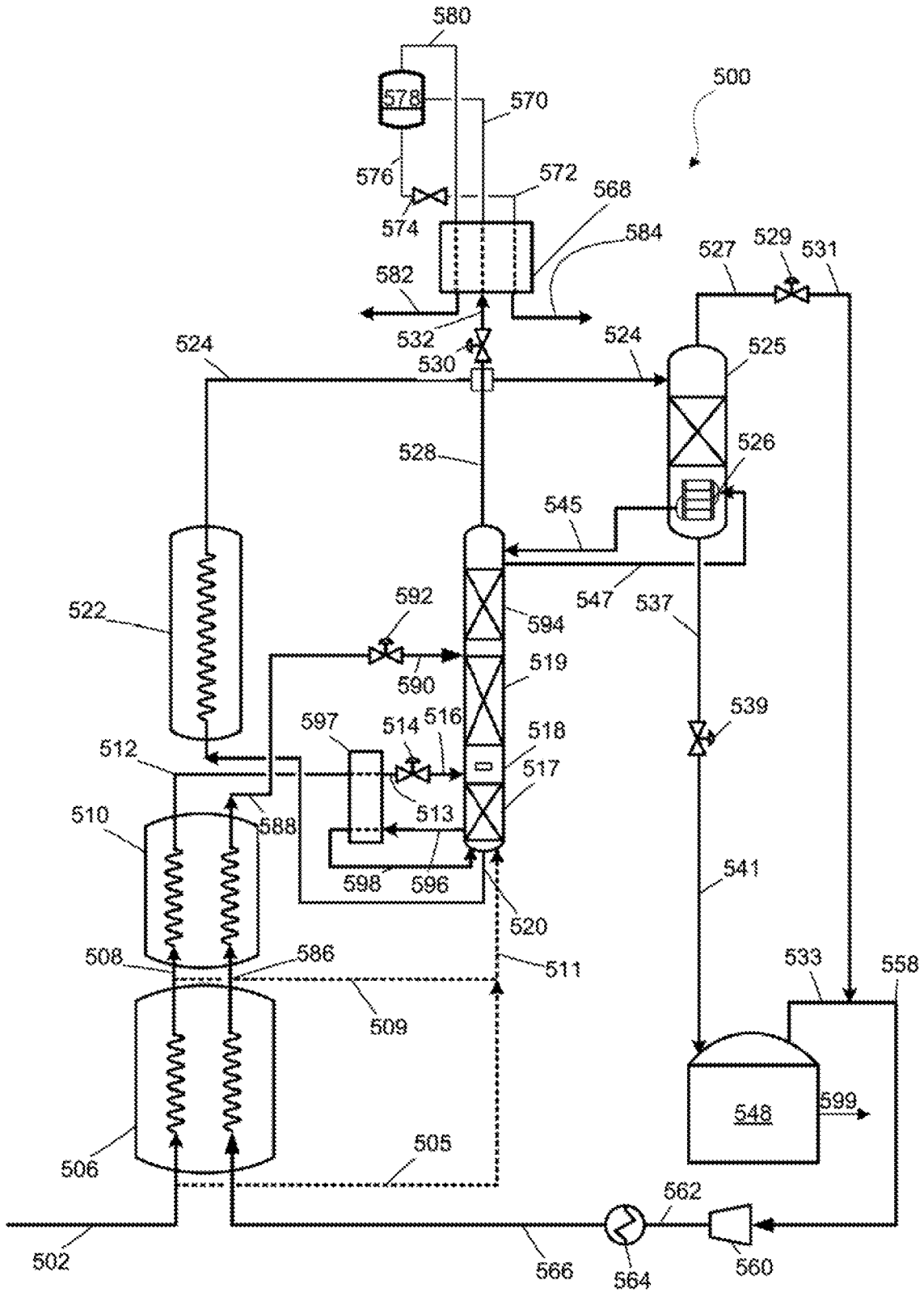
FIG. 5 is a block diagram of a fifth exemplary embodiment of a natural gas liquefaction system having a dedicated nitrogen removal system.

A fifth exemplary embodiment of the system 500 is shown in FIG. 5. In FIG. 5, the subcooled LNG stream 524 enters the top of an N2 stripper column 525 and provides condensing cooling duty to a condenser heat exchanger 526 located within the N2 stripper column 525. A second overhead stream 547 is withdrawn from the upper end of the N2 rectifier column 518 and is condensed in the condenser heat exchanger 526 to produce an at least partially liquefied nitrogen enriched stream 545 that is reintroduced into the upper end of the N2 rectifier column 518.

The bottom LNG product 537 from N2 stripper column 525 is sent to a LNG storage tank 548. The overhead stream 527 of N2 stripper column 525 is sent via a valve 529 and line 531 to combine with the BOG gas 533 from the storage tank to produce the recycle stream 558.

Optionally, a slip stream of warm feed gas, such as stream 505 and/or stream 509 could be used to provide additional stripping and re-boiling duty to the bottom of the N2 rectifier column 511.

Figure 6:
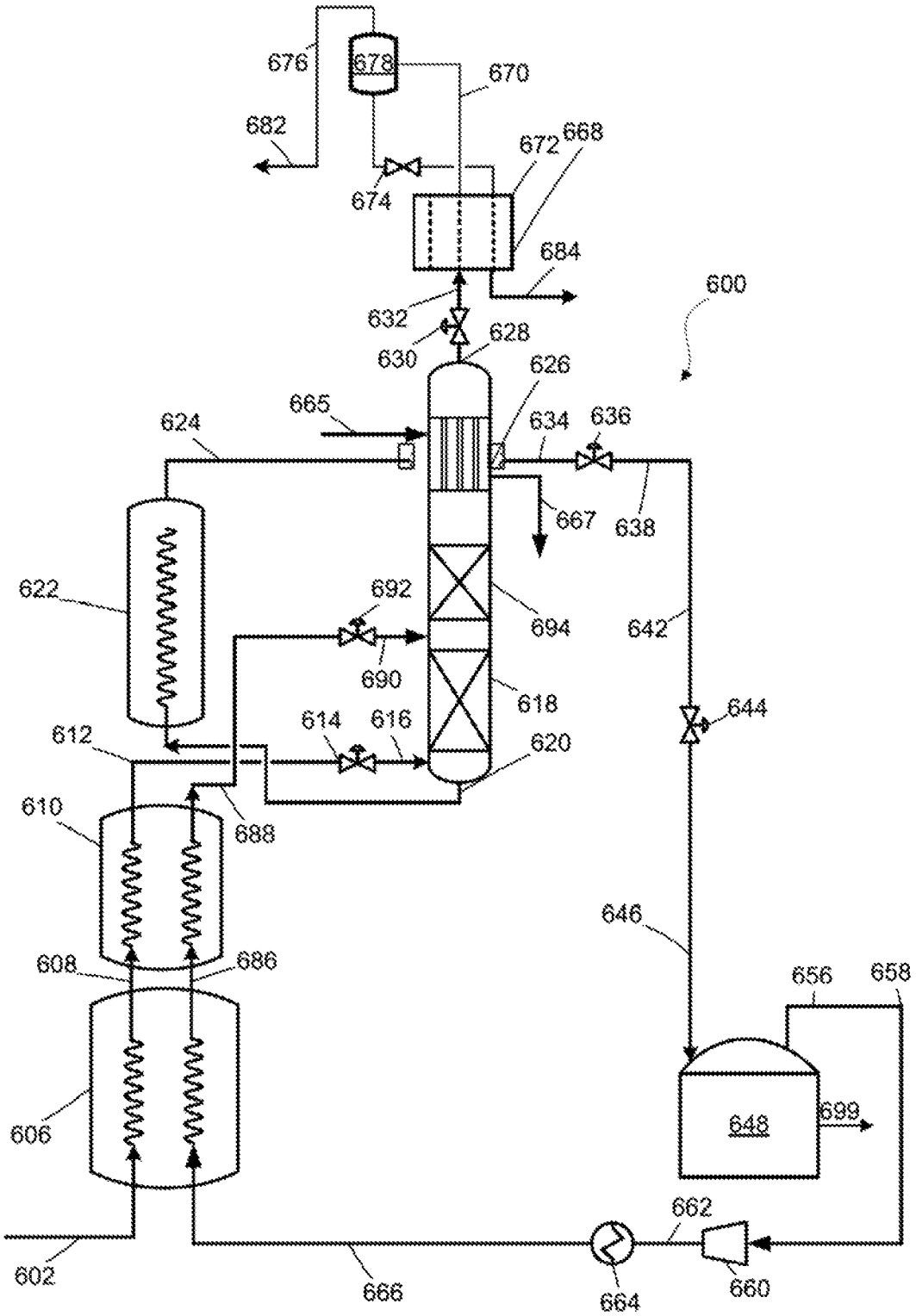
FIG. 6 is a block diagram of a sixth exemplary embodiment of a natural gas liquefaction system having a dedicated nitrogen removal system.

A sixth exemplary embodiment of the system 600 is shown in FIG. 6. This embodiment is very similar to the system 300, except that the cooling duty to the partial condenser 626 of the N2 rectifier column 618 is provided not by LNG, but by a slip stream of refrigerant 665 from the refrigeration loop (see, e.g., FIG. 1). The spent refrigerant 667 exiting the N2 rectifier column 618 is returned to the refrigeration loop.

In this embodiment, the H2/He enriched stream 676 is not sent through the heat exchanger 668, which simplifies its structure.

Figure 7:
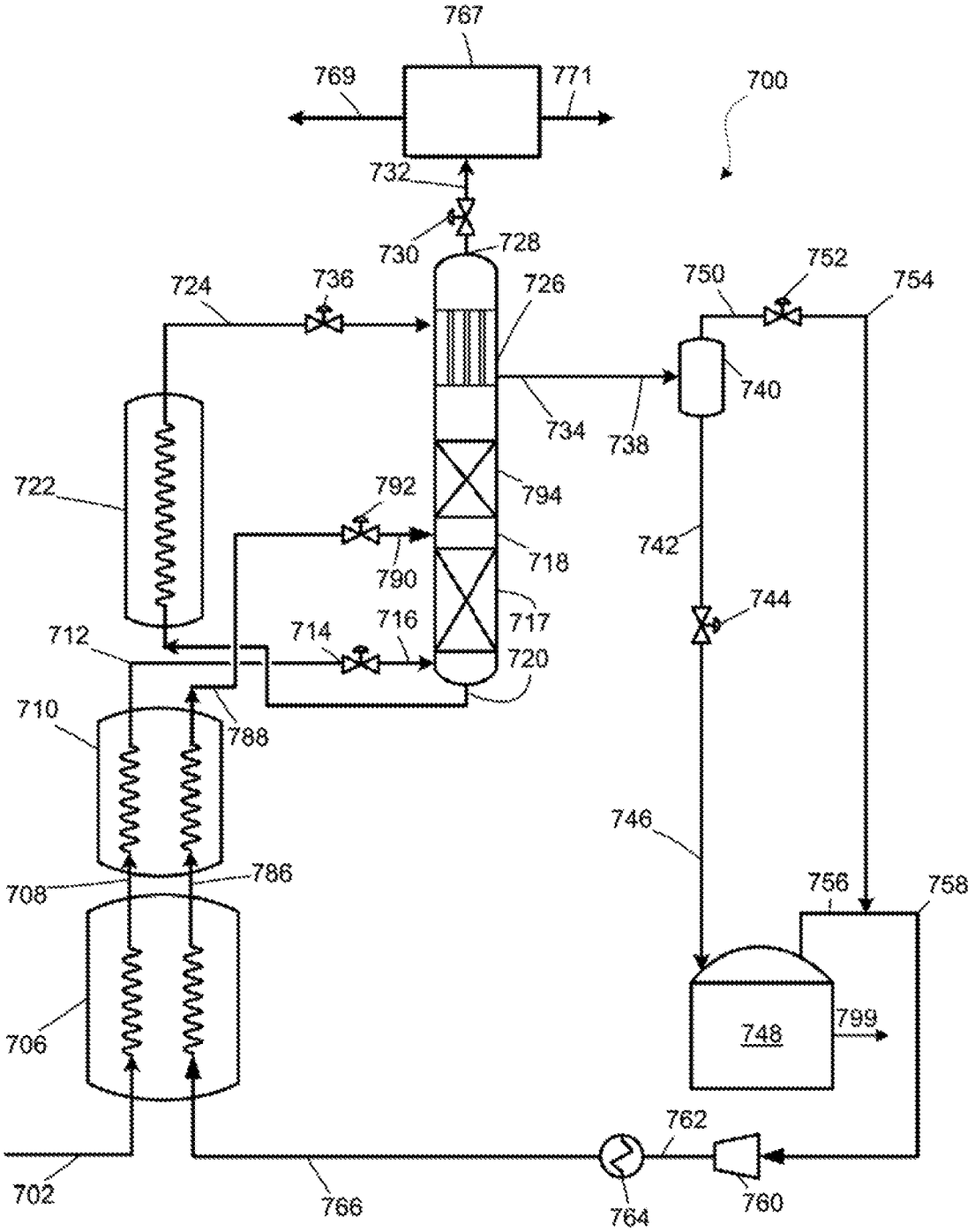
FIG. 7 is a block diagram of a seventh exemplary embodiment of a natural gas liquefaction system having a dedicated nitrogen removal system.

A seventh exemplary embodiment of the system 700 is shown in FIG. 7. In FIG. 7, the N2 rectifier column overhead 728 is transferred via a valve 730 and line 732 for further processing in a pressure swing adsorption (PSA) unit or a membrane unit 767 to further separate H2/He from N2.

Example

This example is based on specific exemplary implementation of the system 300 of FIG. 3. A natural gas feed stream 302 from a coal gasification unit enters the warm bundle 306 and is cooled in a tube circuit to −32 degrees Fahrenheit (−35 degrees C.) using a mixed refrigerant on the shell side of the heat exchanger (not shown). The cooled NG stream 308 is then further cooled using a mixed refrigerant in the middle bundle 310 to −163 degrees Fahrenheit (−108 degrees C.) to form the at least partially liquefied NG stream 312. The at least partially liquefied NG stream 312 is reduced in pressure through the valve 314 to 323 PSIA (2227 kPa), forming the reduced pressure NG stream 316 (which is two-phase). The reduced pressure NG stream 316 is introduced into, and separated in, the bottom end of the N2 rectifier column 318. The resulting vapor, along with the vapor portion of reduced pressure recycle stream 390 rises through the N2 rectified column trays or packing (separation stages) and is progressively purified (with methane being removed), resulting in the overhead stream 328 containing about 0.5 mol percent methane.

The overhead stream 328 may be used as fuel for process heating or other uses. In this example, the overhead stream 328 is further separated using the heat exchanger 368 and separator 378. The overhead stream 328 is directed via a valve 330 and line 332 to the heat exchanger 368, where it is cooled to −274 degrees Fahrenheit (−170 degrees C.). This cooling condenses nitrogen and heavier components, which are separated in the drum 378 to produce a crude hydrogen stream 380 and a nitrogen liquid stream 376. The nitrogen liquid stream 376 is then reduced in pressure at valve 374 and the reduced pressure stream 372 is vaporized in the heat exchanger 368 and vented to the atmosphere as stream 384. The crude hydrogen stream 380 is also warmed in heat exchanger 368, then recycled to the coal gasification plant as stream 382.

TABLE 1

| | Feed | Overhead | N2 Vent | H2 Recycle | LNG | BOG Recycle |
|---|---|---|---|---|---|---|
| Stream # (FIG. 3) | 302 | 328 | 384 | 382 | 399 | 366 |
| H2 mole fraction | 0.0078 | 0.3650 | 0.0357 | 0.5028 | 0.0001 | 0.0693 |
| N2 mole fraction | 0.0192 | 0.5360 | 0.7749 | 0.4360 | 0.0080 | 0.1624 |
| AR mole fraction | 0.0066 | 0.0756 | 0.1460 | 0.0462 | 0.0051 | 0.0363 |
| CO mole fraction | 0.0009 | 0.0184 | 0.0295 | 0.0138 | 0.0005 | 0.0066 |
| C1 mole fraction | 0.9655 | 0.0050 | 0.0140 | 0.0012 | 0.9863 | 0.7254 |
| Total Flow lbmol/hr | 12382 | 262 | 77 | 185 | 12120 | 991 |
| Temperature F. (C.) | 100 (38) | −263 (−164) | −270 (−168) | −270 (−168) | −266 (−166) | 100 (38) |
| Pressure psia (kPa) | 1015 (6998) | 315 (2171) | 131 (903) | 310 (2137) | 14 (97) | 883 (6088) |

The bulk of the feed to the N2 rectifier column 318 is recovered in the bottom liquid stream 320. The bottom liquid stream 320 is then subcooled in the cold bundle 322, exiting as the subcooled LNG stream 324 at a temperature of −263 degrees Fahrenheit (−164 degrees C.). The subcooled LNG stream 324 is reduced in pressure to 18 psia (124 kPa) and partly vaporized in the condenser heat exchanger 326 to provide refrigeration to the N2 rectifier column 318. The LNG stream 334 exiting the condenser heat exchanger 326 is 5 percent molar vapor fraction and is sent to the flash drum 340, where it is separated to bottom LNG product 342, which is sent to the LNG storage tank 348 and the overhead NG stream 350. LNG in the LNG storage tank 348 is stored at atmospheric pressure—14.7 psia (101 kPa). The LNG storage tank 348 produces a liquid LNG stream 399 and a boil-off gas stream 356, that results from additional flash generated when the liquid stream 342 from the flash drum 340 enters the LNG storage tank 348 via a connecting line 346 and from boiloff due to heat leakage into the LNG storage tank 348.

The overhead NG stream 350 from the flash drum 340 is combined with the BOG stream 356 from the LNG storage tank 348, forming the recycle stream 358 which is sent to the BOG compressor 360. The BOG compressor 360 compresses the recycle stream 358 to 887 psia (6116 kPa), forming the compressed recycle stream 362. The compressed recycle stream 362 is then cooled in an air cooler 364 to 100 degrees Fahrenheit (38 degrees C.), forming a BOG recycle stream 366. The BOG recycle stream 366 enters the warm bundle 306 and is cooled in a tube circuit to −32 degrees Fahrenheit (−36 degrees C.) against a mixed refrigerant descending through the shell side of the heat exchanger (not shown). The resulting stream 386 is then further cooled in the middle bundle 310 to −163 degrees Fahrenheit (−108 degrees C.). The resulting stream 312 is reduced in pressure through a valve 392 to 320 psia (2206 kPa), forming reduced pressure recycle stream 390 which is introduced into the N2 rectifier column 318.

While the principles of the invention have been described above in connection with preferred embodiments, it is to be clearly understood that this description is made only by way of example and not as a limitation of the scope of the invention.

The invention claimed is:

1. A method for producing a nitrogen-depleted LNG product, the method comprising:

(a) passing a natural gas feed stream through a first circuit of a main heat exchanger to cool the natural gas feed stream and liquefy at least a portion of the natural gas stream against a first refrigerant, thereby producing a first cooled LNG stream;

(b) withdrawing the first cooled LNG stream from the main heat exchanger;

(c) expanding the first cooled LNG stream to form a first reduced pressure LNG stream;

(d) introducing the first reduced pressure LNG stream into a nitrogen rectifier column at a first location, the first location being located at a bottom end of the nitrogen rectifier column;

(e) withdrawing a first LNG bottoms stream from the bottom end of the nitrogen rectifier column;

(f) withdrawing an overhead stream from the nitrogen rectifier column;

(g) cooling the first LNG bottoms stream to create a subcooled LNG stream;

(h) directing at least a portion of the subcooled LNG stream to a flash drum or an LNG storage tank;

(i) collecting at least one selected from a group consisting of: a flash gas stream from the flash drum and a boil-off gas stream from the LNG storage tank to form a recycle stream;

(j) passing the recycle stream through a second circuit of the main heat exchanger to cool the recycle stream and liquefy at least a portion of the recycle stream, thereby producing an at least partially liquified recycle stream;

(k) withdrawing the at least partially liquified recycle stream from the second circuit of the main heat exchanger before the at least partially liquified recycle stream enters a cold bundle of the main heat exchanger and then expanding the at least partially liquified recycle stream to form a reduced pressure recycle stream; and (l) introducing the reduced pressure recycle stream into the nitrogen rectifier column at a second location, the second location located below the rectifier column overhead and above the first location and at least one separation stage being located in the nitrogen rectifier column between the first location and the second location.

2. The method of claim 1, further comprising:

(m) passing the subcooled liquid LNG stream through a condenser heat exchanger to form a mixed phase LNG stream, the condenser heat exchanger providing cooling duty via indirect heat exchange to the nitrogen column.

3. The method of claim 2, further comprising:

(n) at least partially vaporizing the subcooled liquid LNG stream before performing step (m).

4. The method of claim 1, further comprising:

(o) compressing and cooling the first refrigerant in a refrigeration loop;

(p) withdrawing a slip stream of the first refrigerant to provide cooling duty to the nitrogen rectifier column.

5. The method of claim 1, further comprising:

(q) directing the at least a portion of the subcooled LNG stream to the flash drum.

6. The method of claim 1, further comprising:

(r) compressing and cooling the recycle stream before performing step (j).

7. The method of claim 1, further comprising:

(s) after performing step (b) and before performing step (d), further cooling the first LNG stream by indirect heat exchange against a reboil stream from the bottom end of the nitrogen rectifier column, thereby producing a warmed reboil stream;

(t) introducing the warmed reboil stream into the bottom end of the nitrogen rectifier column.

8. The method of claim 1, wherein step (h) further comprises separating the subcooled liquid LNG stream into the liquid LNG product stream and the vapor LNG product stream in a nitrogen stripper column; and the method further comprises:

(u) withdrawing a nitrogen enriched vapor stream from an upper end of the nitrogen rectifier column, passing the nitrogen enriched vapor stream through a condenser heat exchanger located in the nitrogen stripper column to provide a boiling duty to the nitrogen stripper column, which produces an at least partially liquefied nitrogen enriched stream; and (v) returning the at least partially liquefied nitrogen enriched stream to the upper end of the nitrogen rectifier column.

9. The method of claim 1, further comprising:

(w) further cooling the overhead stream in an overhead hear exchanger and separating a further cooled overhead stream into a nitrogen-enriched stream and a hydrogen/helium-enriched stream;

(x) expanding nitrogen-enriched stream and using the expanded nitrogen-enriched stream to provide a refrigeration duty to the overhead heat exchanger.

10. The method of claim 1, further comprising:

(y) separating the overhead stream into a nitrogen-enriched stream and a hydrogen/helium-enriched stream using a pressure swing adsorption or membrane unit.

11. The method of claim 1, further comprising:

(z) separating the subcooled LNG stream into an LNG product stream and a vapor NG product stream;

wherein step (i) further comprises directing the LNG product stream to the LNG storage tank.

12. The method of claim 11, further comprising:

(aa) combining the boil-off gas stream with the vapor NG product stream to form the recycle stream.

13. The method of claim 1, wherein step (d) comprises introducing the first reduced pressure LNG stream into the nitrogen rectifier column at the first location, the first location being located below any separation stages located within the nitrogen rectifier column.

14. The method of claim 1, wherein step (I) further comprises introducing the reduced pressure recycle stream in the nitrogen rectifier column at the second location, the second location being below at least one separation stage.

15. The method of claim 2, wherein the mixed phase LNG stream is in upstream fluid flow communication with the recycle stream.

16. The method of claim 1, wherein step g comprises:

cooling the first LNG bottoms stream in the cold bundle of the main heat exchanger to create a subcooled LNG stream wherein the cold bundle is colder than the second circuit of the main heat exchanger from which the at least partially liquified recycle stream is withdrawn.

* * * * *